US009401061B2

(12) United States Patent
Luo et al.

(10) Patent No.: US 9,401,061 B2
(45) Date of Patent: Jul. 26, 2016

(54) BANKNOTE PROCESSING DEVICE AND CIRCULATING CASH BOX MECHANISM THEREOF

(71) Applicant: GRG Banking Equipment Co., Ltd., Guangzhou, Guangdong (CN)

(72) Inventors: Panfeng Luo, Guangzhou (CN); Dong Tan, Guangdong (CN)

(73) Assignee: GRG Banking Equipment Co., Ltd., Guangzhou, Guangdong (CN)

( * ) Notice: Subject to any disclaimer, the term of this patent is extended or adjusted under 35 U.S.C. 154(b) by 0 days.

(21) Appl. No.: 14/779,319

(22) PCT Filed: Jul. 8, 2013

(86) PCT No.: PCT/CN2013/078978

§ 371 (c)(1),
(2) Date: Sep. 22, 2015

(87) PCT Pub. No.: WO2014/153901

PCT Pub. Date: Oct. 2, 2014

(65) Prior Publication Data

US 2016/0063792 A1 Mar. 3, 2016

(30) Foreign Application Priority Data

Mar. 29, 2013 (CN) ..... 2013 1 0109850

(51) Int. Cl.
*G07D 11/00* (2006.01)
*B65H 29/16* (2006.01)
(Continued)

(52) U.S. Cl.
CPC ..... *G07D 11/0012* (2013.01); *B65H 29/16* (2013.01); *B65H 29/20* (2013.01); *B65H 31/06* (2013.01)

(58) Field of Classification Search
CPC ..... B65H 31/06; B65H 29/20; B65H 29/16; B65H 29/40; G07D 11/00; G07D 7/02; G07D 11/0012; G07D 11/0021; G07D 2211/00
USPC ..... 271/178, 315
See application file for complete search history.

(56) References Cited

U.S. PATENT DOCUMENTS 4,465,192 A 8/1984 Ohba et al.
4,594,502 A 6/1986 Watanabe
(Continued)

FOREIGN PATENT DOCUMENTS

CN 101266703 A 9/2008
CN 101377869 A 3/2009
(Continued)

OTHER PUBLICATIONS

International Search Report, dated Dec. 12, 2013, from corresponding International Application No. PCT/CN2013/078978.
(Continued)

*Primary Examiner* — David H Bollinger
(74) *Attorney, Agent, or Firm* — Wolfield, Greenfield & Sacks, P.C.

(57) ABSTRACT

A recycling cash box mechanism of a banknote processing device includes a box body and a transmission mechanism configured to be connected to the box body, the transmission mechanism includes a banknote receiving vane wheel configured to be located at a banknote dispensing/receiving port of the recycling cash box mechanism, and a banknote dispensing roller wheel configured to be located opposite to a banknote stacking plate of the box body, and the banknote dispensing roller wheel is configured to be located at a lateral portion of the banknote receiving vane wheel to form a banknote blocking mechanism.

20 Claims, 6 Drawing Sheets

(51) Int. Cl.
*B65H 29/20* (2006.01)
*B65H 31/06* (2006.01)

(56) References Cited

U.S. PATENT DOCUMENTS

| | | | | |
|---|---|---|---|---|
| 2006/0012101 | A1 | 1/2006 | Katou et al. | |
| 2014/0083915 | A1* | 3/2014 | Nakada | G07D 11/0021 209/552 |

FOREIGN PATENT DOCUMENTS

| | | | |
|---|---|---|---|
| CN | 101452592 | A | 6/2009 |
| CN | 102874640 | A | 1/2013 |
| CN | 102959594 | A | 3/2013 |
| CN | 103177504 | A | 6/2013 |
| JP | 59-143832 | A | 8/1984 |
| JP | 2011241068 | A | 12/2011 |
| KR | 100596311 | B1 | 7/2006 |

OTHER PUBLICATIONS

Chinese Office Action, dated Sep. 2, 2014, from corresponding Chinese Application No. 201310109850.0.

Written Opinion, dated Jan. 9, 2014, from a corresponding International Application No. PCT/CN2013/078978.

Extended European Search Report, dated Mar. 11, 2016, from corresponding European Application No. 13879687.5.

* cited by examiner

BANKNOTE PROCESSING DEVICE AND CIRCULATING CASH BOX MECHANISM THEREOF

This application is the national phase of International Application No. PCT/CN2013/078978, titled "BANKNOTE PROCESSING DEVICE AND CIRCULATING CASH BOX MECHANISM THEREOF", filed on Jul. 8, 2013, which claims the benefit of priority to Chinese Patent Application No. 201310109850.0 titled "BANKNOTE PROCESSING DEVICE AND RECYCLING CASH BOX MECHANISM THEREOF", filed with the Chinese State Intellectual Property Office on Mar. 29, 2013, each of which applications is incorporated herein by reference to the maximum extent allowable by law.

TECHNICAL FIELD

The present application relates to the field of banknote processing technique, and particularly to a cash box mechanism of a banknote processing device. The present application also relates to a banknote processing device having the cash box mechanism.

BACKGROUND

With the continuous development of economy, the processing amount of banknotes is continuously increased, and the requirement for processing capacity of the banknote processing device is increased accordingly. At present, main functions of the widely used banknote processing device include banknote withdrawing, banknote depositing, bank transfer and etc., and in these operations, the banknote processing device mainly uses a recycling cash box mechanism to store and dispense banknotes.

The recycling cash box mechanism is capable of storing the banknotes which are deposited by customers and dispensing banknotes to customers performing a banknote withdrawing operation. For realizing this function, the widely used recycling cash box mechanism at present mainly includes a box body and a transmission mechanism arranged inside the box body. The transmission mechanism mainly includes a stacking roller, a supporting roller, a gate roller, a brush roller and etc., the stacking roller cooperates with the supporting roller to clamp the banknotes, and the gate roller and the brush roller are used to prevent more than one piece of banknote from being simultaneously conveyed. Auxiliary mechanisms are also required to cooperate with the stacking roller, the supporting roller, the gate roller and the brush roller, to ensure that the banknotes can be orderly stacked inside the box body and smoothly discharged from the box body.

During the operation of the recycling cash box mechanism, each fit clearance between respective rollers of the transmission mechanism needs to be adjusted according to the thickness of different banknotes, to ensure that the banknotes can be reliably conveyed, and this adjusting process makes the operation of the recycling cash box mechanism more complicated.

Moreover, in addition to the stacking roller, the supporting roller, the gate roller and the brush roller, the transmission mechanism also needs auxiliary mechanisms to assist the operation, which makes the entire transmission mechanism have a complicated structure. With the amount of the banknotes to be conveyed in the recycling cash box mechanism increases constantly, when entering into the recycling cash box mechanism, the banknote is apt to collide with the banknotes inside the box body, which may cause banknote deformation and jam.

In conclusion, a technical issue to be addressed by those skilled in the art urgently is to solve the problem that the operation of the recycling cash box mechanism is complicated.

SUMMARY

An object of the present application is to provide a recycling cash box mechanism of banknote processing device, and the mechanism is easy to operate. Another object of the present application is to provide a banknote processing device having the recycling cash box mechanism.

For realizing above objects, the following technical solutions are provided according to the present application.

A recycling cash box mechanism of a banknote processing device includes a box body and a transmission mechanism configured to be connected to the box body, the transmission mechanism includes a banknote receiving vane wheel configured to be located at a banknote dispensing/receiving port of the recycling cash box mechanism, and a banknote dispensing roller wheel configured to be located opposite to a banknote stacking plate of the box body, and the banknote dispensing roller wheel is configured to be located at a lateral portion of the banknote receiving vane wheel to form a banknote blocking mechanism.

Preferably, in the recycling cash box mechanism, the banknote dispensing roller wheel includes a first roller wheel and a second roller wheel rotatably cooperating with the first roller wheel, a rotational shaft of the first roller wheel and a rotational shaft of the second roller wheel are fixedly connected, and the rotational shaft of the second roller wheel is rotatable around its own axis.

Preferably, in the recycling cash box mechanism, two or more groups of the banknote dispensing roller wheels are provided, and two sides of the banknote receiving vane wheel are each provided with at least one group of the banknote dispensing roller wheels.

Preferably, in the recycling cash box mechanism, a connecting line between banknote contacting points of at least two groups of the banknote dispensing roller wheels respectively located at the two sides of the banknote receiving vane wheel is in parallel with an axis of the banknote receiving vane wheel.

Preferably, in the recycling cash box mechanism, a roller wheel driving mechanism connected to the banknote dispensing roller wheel includes a rotational member fixed with respect to the rotational shaft of the second roller wheel, an electromagnetism component cooperating with the rotational member to apply a rotation driving force, and a reset member connected to the rotational member.

Preferably, in the recycling cash box mechanism, the banknote receiving vane wheel and the banknote dispensing roller wheel are both installed outside the box body, and a gate is rotatably provided at one end, opposite to the banknote receiving vane wheel and the banknote dispensing roller wheel, of the box body.

Preferably, in the recycling cash box mechanism, one end of the box body provided with the gate is provided with a banknote blocking rod, the banknote blocking rod is located between the banknote dispensing roller wheel and a banknote pressing plate inside the box body.

Preferably, in the recycling cash box mechanism, the banknote blocking rod includes a first banknote blocking rod and a second banknote blocking rod, both of which are respectively located at two sides of the banknote pressing plate.

Preferably, in the recycling cash box mechanism, a banknote conveyor belt is arranged inside the box body, the banknote stacking plate is provided with a conveyor belt accommodating groove, and an upper surface of the banknote conveyor belt is higher than an upper surface of the banknote stacking plate.

In the above technical solutions, the recycling cash box mechanism of the banknote processing device according to the present application includes a box body and a transmission mechanism which can be connected to the box body, the transmission mechanism includes a banknote receiving vane wheel configured to be located at a banknote dispensing/receiving port of the recycling cash box mechanism, and a banknote dispensing roller wheel configured to be located opposite to a banknote stacking plate of the box body, and the banknote dispensing roller wheel is configured to be located at a lateral portion of the banknote receiving vane wheel to form a banknote blocking mechanism. When the recycling cash box mechanism operates, banknotes entering from the banknote dispensing/receiving port are conveyed by the banknote receiving vane wheel, and when rotating with the banknote receiving vane wheel, the banknotes are blocked by the banknote blocking mechanism formed by the banknote dispensing roller wheel, and then fall on the banknote stacking plate of the box body and are stacked in the box body. When the recycling cash box mechanism needs to dispense banknotes, the banknotes inside the box body 29 keep moving toward the banknote dispensing roller wheel along the banknote stacking plate, and the banknote dispensing roller wheel keeps rotating to separate the whole stack of banknotes into single sheet of banknote, to facilitate conveying the banknotes.

According to the above description, the recycling cash box mechanism according to the present application adopts a combination of the banknote receiving vane wheel and the banknote dispensing roller wheel to stack and dispense the banknotes, thus the thickness variation of the banknotes will not affect the operation of the recycling cash box mechanism. Compared with the content introduced in the background art, the above mechanism does not need to adjust the fit clearances between parts of the mechanism according to the thickness variation of different banknotes in working, thereby greatly simplifying the operation of the recycling cash box mechanism.

A banknote processing device is also provided according to the present application, which includes a recycling cash box mechanism, the recycling cash box mechanism is the recycling cash box mechanism according to any one of the above solutions. Since the recycling cash box mechanism has the above technical effects, therefore the banknote processing device having the recycling cash box mechanism also has the corresponding technical effects.

BRIEF DESCRIPTION OF THE DRAWINGS

For more clearly illustrating embodiments of the present application or the technical solution in the conventional technology, drawings referred to describe the embodiments or the conventional technology will be briefly described hereinafter. Apparently, the drawings in the following description are only several embodiments of the present application, and for the person skilled in the art other drawings may be obtained based on these drawings without any creative efforts.

Figure 1:
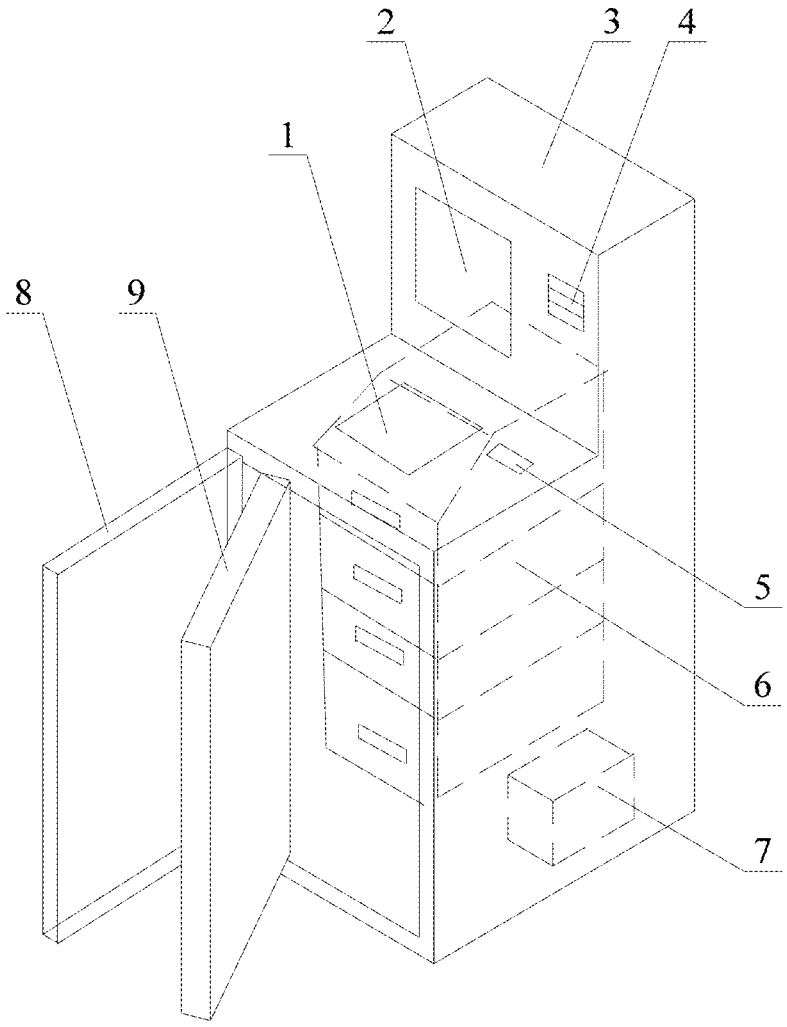
FIG. 1 is a schematic view showing the structure of a banknote processing device.

Reference numerals in FIGS. 1 to 8:

| | | | |
|---|---|---|---|
| 1 | banknote depositing/withdrawing port, | 2 | display unit, |
| 3 | shell, | 4 | card and detailed statement processing unit, |
| 5 | input unit, | 6 | banknote processing unit, |
| 7 | main body controller, | 8 | front door, |
| 9 | vault door; | 11 | banknote inlet/outlet, |
| 12 | banknote separating wheel, | 13 | reversing block, |
| 14 | connecting passage, | 15 | deposit conveying passage, |
| 16 | recycling conveying passage, | 17 | recycling conveying passage, |
| 18 | recycling conveying passage, | 19 | recycling cash box mechanism, |
| 20 | deposit cash box mechanism, | 21 | banknote temporary storage unit, |
| 22 | banknote identification unit, | a | arrow, |
| b | arrow, | c | arrow; |
| 26 | box cover, | 27 | gate, |
| 28 | pushing shaft, | 29 | box body, |
| 30 | padlock, | 31 | banknote pressing plate, |
| 32 | banknote conveyor belt, | 33 | first banknote blocking rod, |
| 34 | second banknote blocking rod, | 35 | first driving wheel, |
| 36 | first transmission wheel, | 37 | second transmission wheel, |
| 38 | third transmission wheel, | 39 | fourth transmission wheel, |
| 40 | fifth transmission wheel, | 41 | banknote dispensing/receiving port, |
| 42 | pulley, | 43 | banknote receiving vane wheel, |
| 44 | second driving wheel, | 45 | electromagnetism component, |
| 46 | banknote dispensing roller wheel, | 461 | first roller wheel, |

-continued

| | | | |
|---|---|---|---|
| 462 | second roller wheel, | 463 | rotational shaft, |
| 464 | rotational shaft, | 465 | connecting plate, |
| 47 | banknote dispensing conveying passage, | 48 | pushing lever, |
| 49 | rotational member, | 50 | reset lever, |
| 51 | reset member. | | |

DETAILED DESCRIPTION

The core of the present application is to provide a recycling cash box mechanism of a banknote processing device, wherein the mechanism is easy to operate, and another core of the present application is to provide a banknote processing device including the recycling cash box mechanism.

For those skilled in the art to better understand technical solutions of the present application, the present application is described in detail in conjunction with drawings and embodiments hereinafter.

A recycling cash box mechanism of a banknote processing device is provided according to embodiments of the present application, and can be applied in banknote processing devices such as an automatic cash dispenser and an automatic teller machine. The structure of the recycling cash box mechanism according to the embodiments of the present application is described in detail by taking the recycling cash box mechanism used in the automatic teller machine as an example.

As shown in FIG. 1, the automatic teller machine includes a display unit 2, a shell 3, a card and detailed statement processing unit 4, an input unit 5, a banknote processing unit 6, a main body controller 7, a front door 8 and a vault door 9, and a banknote depositing/withdrawing port 1 is provided on the shell 3. The display unit 2 is configured to display an image containing detailed information of various kinds of transactions and options and etc. The shell 3 is an installation base for the whole automatic teller machine. The card and detailed statement processing unit 4 is mainly used for reading information of cards and issuing detailed statements. The input unit 5 is a unit for users to input necessary information, and mainly includes a keyboard and etc. The banknote processing unit 6 is used to receive banknotes placed into the banknote depositing/withdrawing port 1 or dispense banknotes via the banknote depositing/withdrawing port 1 according to the cash withdrawing or depositing operation of the user. The main body controller 7 is configured to control the automatic teller machine on the whole, and to accurately control the operation states of each part in the automatic teller machine mainly by processing signals sent from sensors. The entire banknote processing unit 6 can be seen when the front door 8 is opened, and a deposit cash box mechanism and a recycling cash box mechanism can be seen when the vault door 9 is opened.

Figure 2:
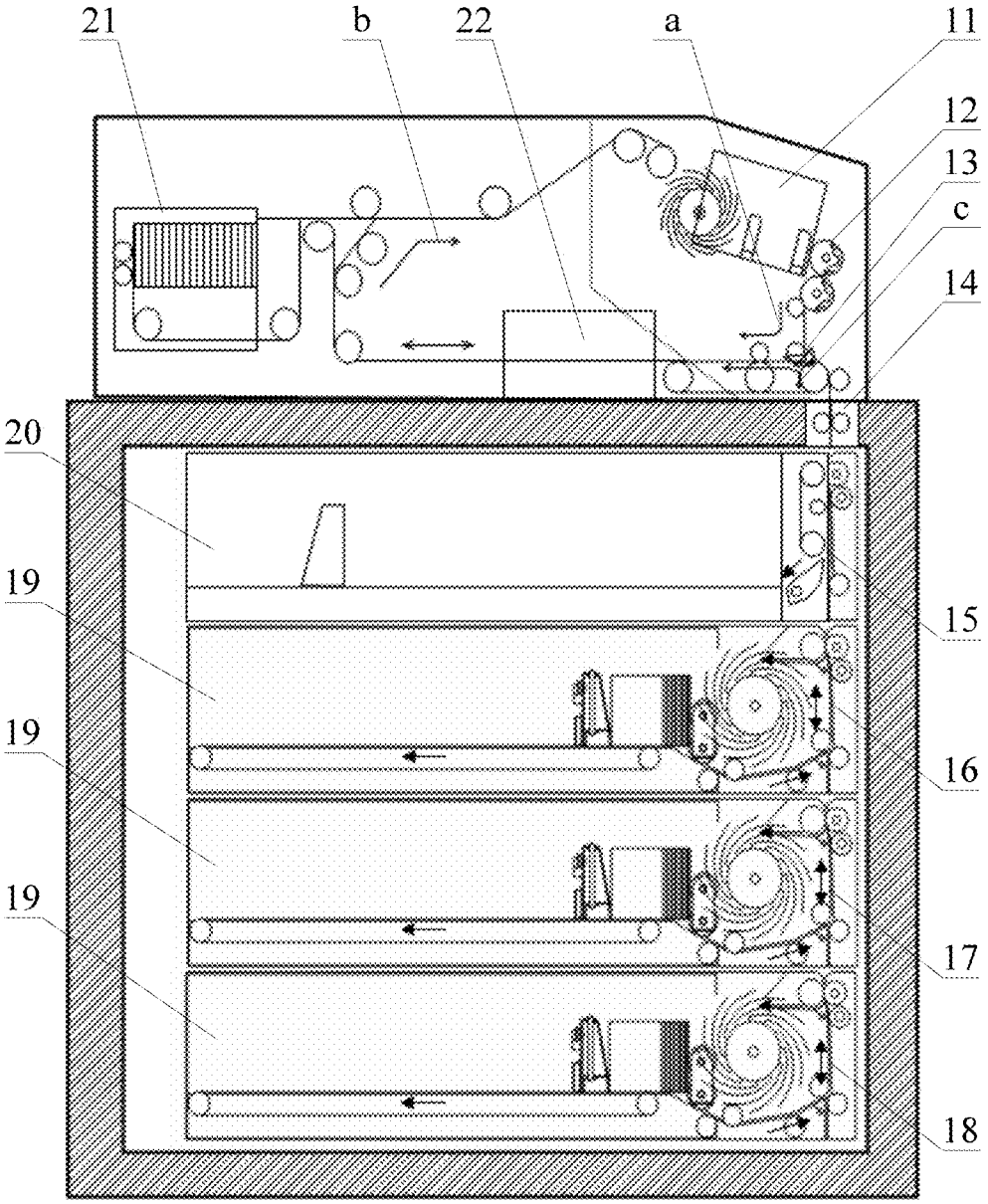
FIG. 2 is a schematic view showing the structure of a banknote processing unit.
Figure 3:
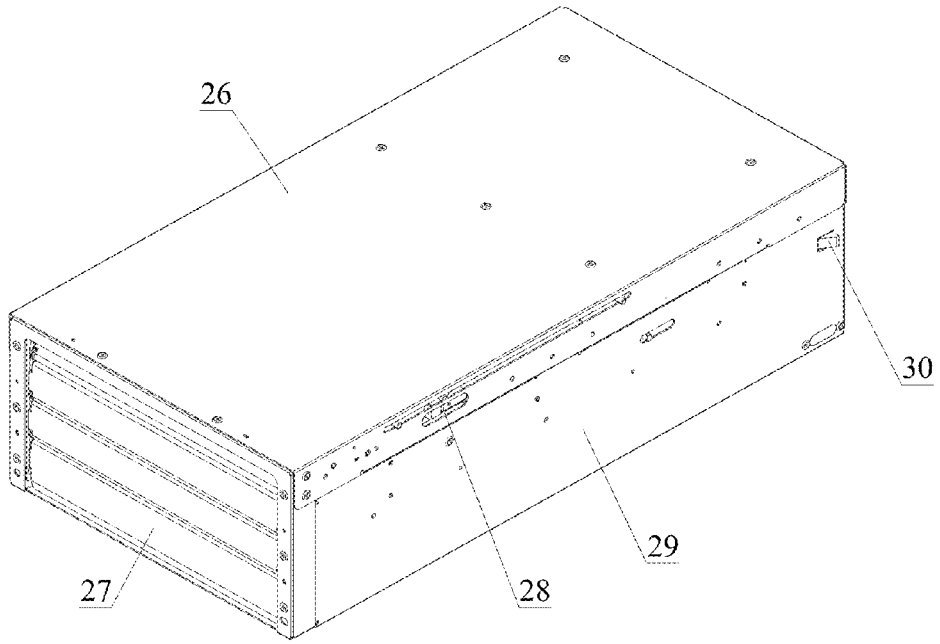
FIG. 3 is a schematic view showing the partial structure of a recycling cash box mechanism according to an embodiment of the present application.
Figure 4:
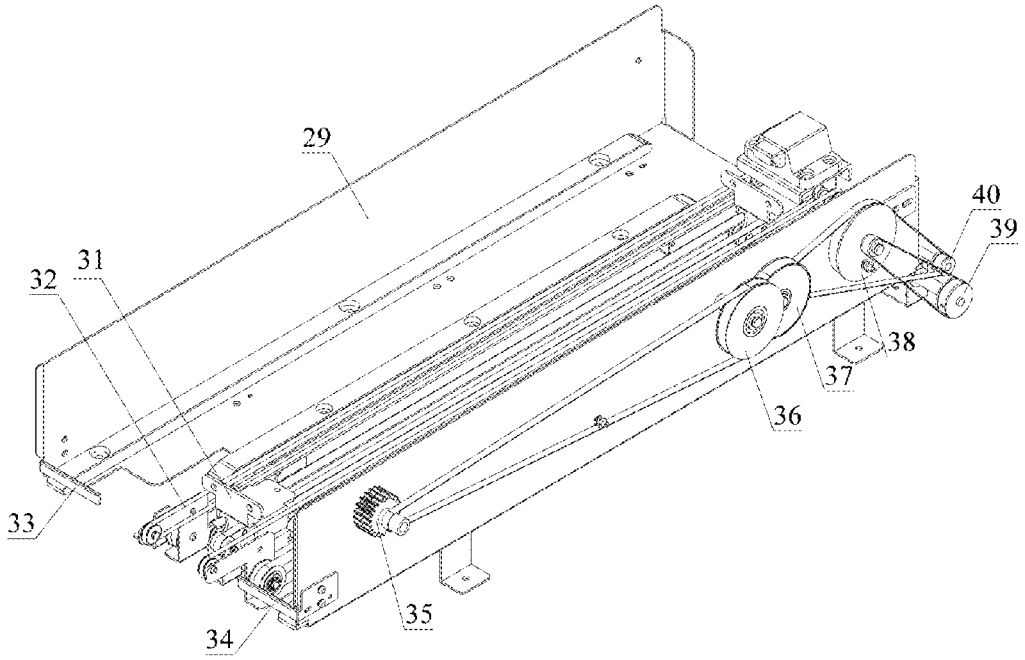
FIG. 4 is a schematic view showing the internal structure of a box body of the recycling cash box mechanism according to an embodiment of the present application.

As shown in FIG. 2, the banknote processing unit 6 mainly includes a banknote inlet/outlet 11, a banknote separating wheel 12, a reversing block 13, a connecting passage 14, a vault, and a deposit conveying passage 15, a recycling conveying passage 16, a recycling conveying passage 17, a recycling conveying passage 18, a recycling cash box mechanism 19, a deposit cash box mechanism 20, a banknote temporary storage unit 21 and a banknote identification unit 22. The banknotes move in the banknote processing unit 6 through multiple banknote conveying passages, and the reversing block 13 is used to switch different banknote conveying passages to allow the banknotes to be conveyed along a target path, and is generally driven by an electromagnetic mechanism. The vault is used for placing each recycling cash box mechanism 19 and the deposit cash box mechanism 20, and the banknote conveying passages above the vault are connected to the banknote conveying passages inside the vault via the connecting passage 14. A groove is provided on the vault to accommodate the connecting passage 14, and the length of the groove is configured to allow the banknotes to pass through, and the width of the groove is the width of the driving wheel in the connecting passage 14. The driving wheels are used for clamping banknotes delivered from the upward side of the connecting passage 14, and the power source of the driving wheels may adopt an independent driving source and may also be introduced from other part of the banknote processing device via a gear transmission mechanism. The deposit cash box mechanism 20 is mainly used for storing banknotes deposited by the customers, and the recycling cash box mechanism 19 can not only store banknotes deposited by the customers but also provide banknotes for the customers performing a withdrawing operation. The number of the deposit cash box mechanism 20 and the number of the recycling cash box mechanism 19 can be flexibly set according to specific application occasions.

The customer firstly puts the banknotes into the banknote inlet/outlet 11 when depositing banknotes, the banknotes inside the banknote inlet/outlet 11 are separated into single sheet of banknote by the banknote separating wheel 12, to be easy to convey. Under the action of the reversing block 13, the banknotes are conveyed from the banknote conveying passage indicated by an arrow a into the banknote identification unit 22, the banknotes identified to be qualified are sent into the banknote temporary storage unit 21 while the banknotes identified to be unqualified are sent back to the banknote inlet/outlet 11 via the banknote conveying passage indicated by an arrow b and then are returned to the customer. After all the banknotes are identified, the qualified banknotes in the banknote temporary storage unit 21 pass through the banknote identification unit 22 and pass through the connecting passage 14 through the banknote conveying passage indicated by an arrow c, and finally enter into the deposit cash box mechanism 20 via the banknote conveying passage 15 or enter into the corresponding recycling cash box mechanism 19 via one of the recycling conveying passage 16, the recycling conveying passage 17 and the recycling conveying passage 18. When the customer needs to withdraw money, the banknotes in the recycling cash box mechanism 19 are delivered into the banknote identification unit 22 through the corresponding recycling conveying passage 16, 17 or 18, and further delivered into the banknote inlet/outlet 11, and finally are taken out by the customer.

As shown in FIGS. 3 to 7, the recycling cash box mechanism according to an embodiment of the present application includes a box cover 26, a box body 29, a padlock 30, a handle, a banknote pressing plate 31, a banknote dispensing/receiving port 41, a pulley 42, a transmission mechanism and a banknote dispensing conveying passage 47. The transmission mechanism can be connected to the box body 29 and includes a banknote receiving vane wheel 43 and a banknote dispensing roller wheel 46. The box cover 26 and the box body 29 form a space for accommodating banknotes, a banknote stacking plate is provided at the bottom of the box body 29, and generally, the banknote stacking plate is a base plate of the box body 29. The box body 29 is the installation base for most parts of the recycling cash box mechanism, and the padlock 30, the banknote pressing plate 31, the banknote dispensing/receiving port 41, the pulley 42, the banknote receiving vane wheel 43, the banknote dispensing roller wheel 46 and the banknote dispensing conveying passage 47 can all be arranged on the box body 29. The padlock 30 is used for positioning the box body 29 with respect to the vault. An operator can disassemble the recycling cash box mechanism via the handle, to realize the banknote replenishment and recycle or the maintenance of the recycling cash box mechanism and etc. The banknote pressing plate 31 is slidable with respect to the box body 29 and is connected to the box body 29 via a reset member, such as a spring, to allow the banknote pressing plate 31 to automatically reset in the banknote dispensing process. The pulley 42 may guide the banknotes entering from the banknote dispensing/receiving port 41 into a deposit conveying passage, the deposit conveying passage is arranged to butt the banknote receiving vane wheel 43, that is, the banknote receiving vane wheel 43 is located at the banknote dispensing/receiving port 41 of the recycling cash box mechanism. The banknote dispensing roller wheel 46 is opposite to the banknote stacking plate, that is, the banknotes on the banknote stacking plate may move toward the banknote dispensing conveying passage 47 through the banknote dispensing roller wheel 46, and the banknote dispensing roller wheel 46 can be located at a lateral side of the banknote receiving vane wheel 43 to form a banknote blocking mechanism. For avoiding the banknotes being stopped after collide with the banknote dispensing roller wheel 46, the banknote dispensing roller wheel 46 may slowly rotate at a certain speed, to bring the banknotes onto the banknote stacking plate.

When the customer deposits money, the qualified banknotes in the banknote temporary storage unit enter from the banknote dispensing/receiving port 41 of the recycling cash box mechanism, and the banknotes move along the deposit conveying passage under the action of the pulley 42 and are conveyed by the rotating banknote receiving vane wheel 43, and when rotating with the banknote receiving vane wheel 43, the banknotes will be blocked by the banknote blocking mechanism formed by the banknote dispensing roller wheel 46. At this time, the rotating vanes of the banknote receiving vane wheel 43 apply a thrust force on the banknotes to make the banknotes fall on the banknote stacking plate in the box body 29 and being stacked in the box body 29, and the banknotes further apply an action force on the banknote pressing plate 31, to make the banknote pressing plate 31 to slide with respect to the banknote stacking plate, and the spring between the banknote pressing plate 31 and the box body 29 is then stretched. When the customer withdraws money, the banknote receiving vane wheel 43 stops rotating, the spring between the banknote pressing plate 31 and the box body 29 recovers to the original state, to make the banknotes inside the box body 29 to keep moving toward the banknote dispensing roller wheel 46 along the banknote stacking plate, and the banknote dispensing roller wheel 46 may keep rotating to separate the whole stack of banknotes into single sheet of banknote, to facilitate the banknote entering into the banknote dispensing conveying passage 47 and further being conveyed to the banknote dispensing/receiving port 41.

According to the above description, the recycling cash box mechanism according to the embodiments of the present application adopts a combination of the banknote receiving vane wheel 43 and the banknote dispensing roller wheel 46 to stack and dispense the banknotes, thus the thickness variation of the banknotes will not affect the operation of the recycling cash box mechanism. Compared with the content introduced in the background art, the above mechanism does not need to adjust the fit clearances between parts of the mechanism according to the thickness variation of different banknotes in working, thereby greatly simplifying the operation of the recycling cash box mechanism.

As shown in FIGS. 5 to 8, in a further technical solution, the banknote dispensing roller wheel 46 includes a first roller wheel 461 and a second roller wheel 462 rotatably cooperating with the first roller wheel 461. A rotation shaft 463 of the first roller wheel 461 is fixedly connected to a rotation shaft 464 of the second roller wheel 462, and the rotation shaft 464 of the second roller wheel 462 is rotatable around its own axis. Generally, the rotation shaft 464 of the second roller wheel 462 may be positioned on the box body 29. In the banknote depositing process, the banknote dispensing roller wheel 46 needs to be located at the lateral side of the banknote receiving vane wheel 43 to form the banknote blocking mechanism, that is, the first roller wheel 461 is located at the lateral side of the banknote receiving vane wheel 43 and the whole banknote dispensing roller wheel 46 is located in the rotation range of the banknote receiving vane wheel 43. In the banknote dispensing stage, the rotation shaft 464 of the second roller wheel 462 rotates around its own axis under the action of the driving mechanism, and the rotation shaft 463 of the first roller wheel 461 is fixedly connected to the rotation shaft 464 of the second roller wheel 462, to make the first roller wheel 461 rotate with respect to the second roller wheel 462, and at this moment, the whole banknote dispensing roller wheel 46 interacts with the stacked banknotes with a large area, to better separate and convey the banknotes. The roller wheel driving mechanism used for realizing the rotation of the rotation shaft 464 of the second roller wheel 462 may adopt a servo motor which can be used to control the working state of the banknote dispensing roller wheel 46 according to the working state of the recycling cash box mechanism. Besides, the rotation shaft 463 of the first roller wheel 461 and the rotation shaft 464 of the second roller wheel 462 may be fixedly connected by a connecting rod, and a connecting plate 465 is adopted in the present application preferably to fixedly connect the rotation shafts 463 and 464, and the connecting plate 465 may be embodied as a metal plate.

Compared to of the solution using a single roller wheel to implement the banknote blocking and separating function, the action area between the banknotes and the above banknote dispensing roller wheel 46 formed by the first roller wheel 461 and the second roller wheel 462 is greatly increased, and apparently, the banknote dispensing roller wheel 46 may effectively optimize the operational reliability of the whole recycling cash box mechanism.

Considering that two ends of the banknote are usually extended out of the vanes of the banknote receiving vane wheel 43 when the banknote is in the banknote receiving vane wheel 43, two or more groups of the banknote dispensing roller wheels 46 are provided in the embodiment of the present application, to prevent the banknote dispensing roller wheels 46 from only acting on one end of the banknote that may cause the banknote unsteady condition. Further, two sides of the banknote receiving vane wheel 43 are respectively provided with one group of the banknote dispensing roller wheels 46, to ensure that two ends of the banknote are in contact with the banknote dispensing roller wheels 46, to realize the above object. Furthermore, during the banknote dispensing stage, the action area between the banknote dispensing roller wheels 46 and the banknotes further increases as the number of groups of the banknote dispensing roller wheels 46 increases, therefore the banknote separating intensity is better.

However, in the case that two or more groups of the banknote dispensing roller wheels 46 are working, if the banknote contact points of the two groups of the banknote dispensing roller wheels 46 respectively at two sides of the banknote receiving vane wheel 43 are arranged in a certain time sequence or are distributed in disorder, a part of the banknotes are not in contact with the two groups of the banknote dispensing roller wheels 46 simultaneously, which may result in a slight swing of the banknotes, thus the movement of the banknotes is still unsteady. For solving this problem, in the recycling cash box mechanism of the present application, a connecting line between the banknote contacting points of the banknote dispensing roller wheels 46 respectively at two sides of the banknote receiving vane wheel 43 is in parallel with the axis of the banknote receiving vane wheel 43. It can be understood that, when the banknotes move into the banknote receiving vane wheel 43, the extending direction of the bottom of the banknotes is approximately in parallel with the axis of the banknote receiving vane wheel 43, therefore the above arranging manner can greatly increase the probability of the banknotes simultaneously contacting with the two groups of the banknote dispensing roller wheels 46 respectively at two sides of the banknote receiving vane wheel 43.

Figure 5:
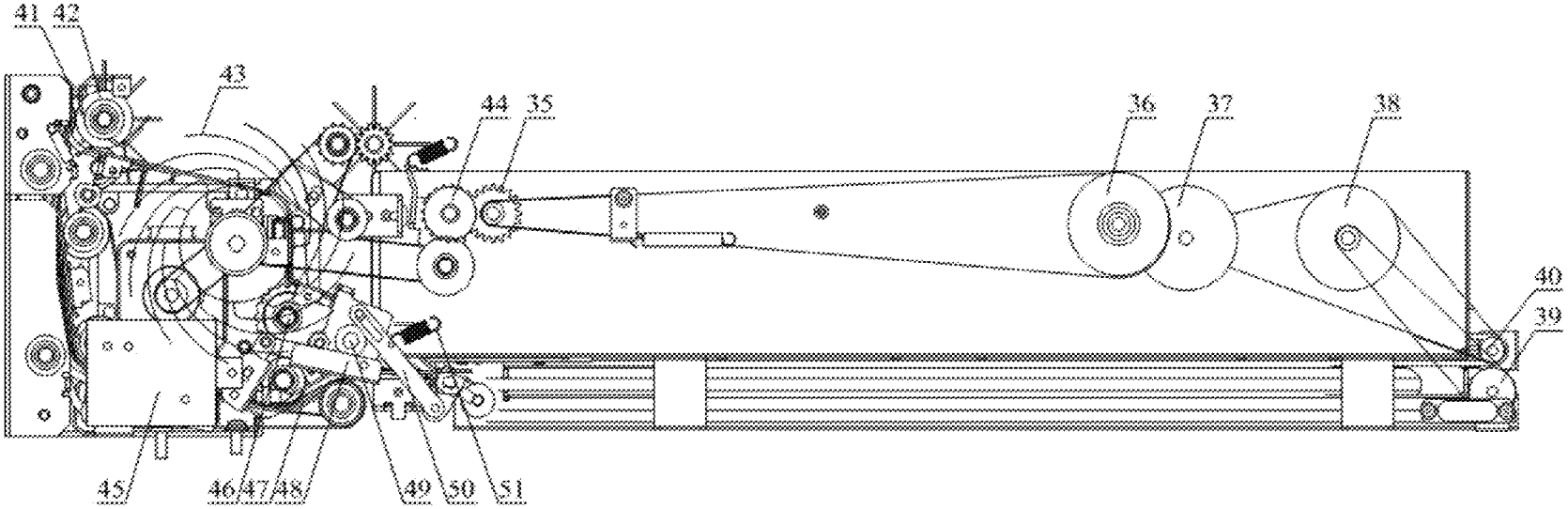
FIG. 5 is a schematic view showing the structure of a recycling cash box mechanism according to an embodiment of the present application.
Figure 6:
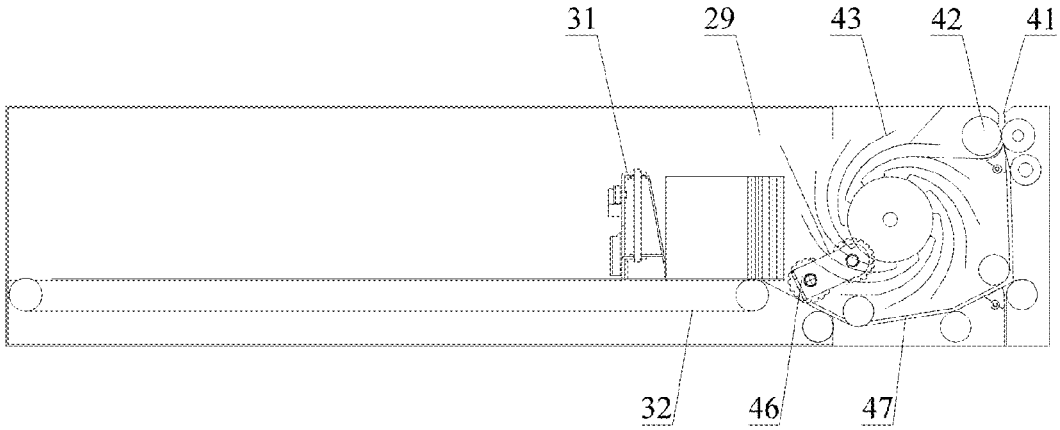
FIG. 6 is a schematic view showing the structure of the recycling cash box mechanism according to an embodiment of the present application in a banknote depositing stage.
Figure 7:
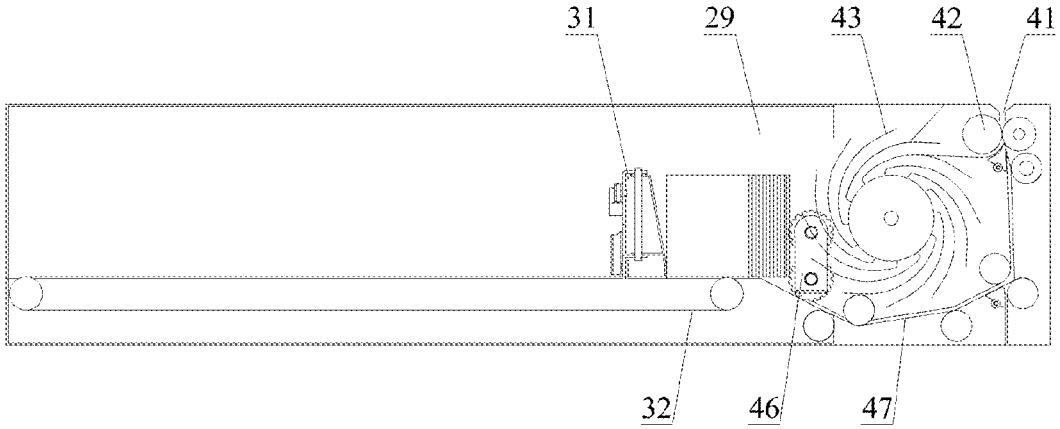
FIG. 7 is a schematic view showing the structure of the recycling cash box mechanism according to an embodiment of the present application in a banknote dispensing stage.
Figure 8:
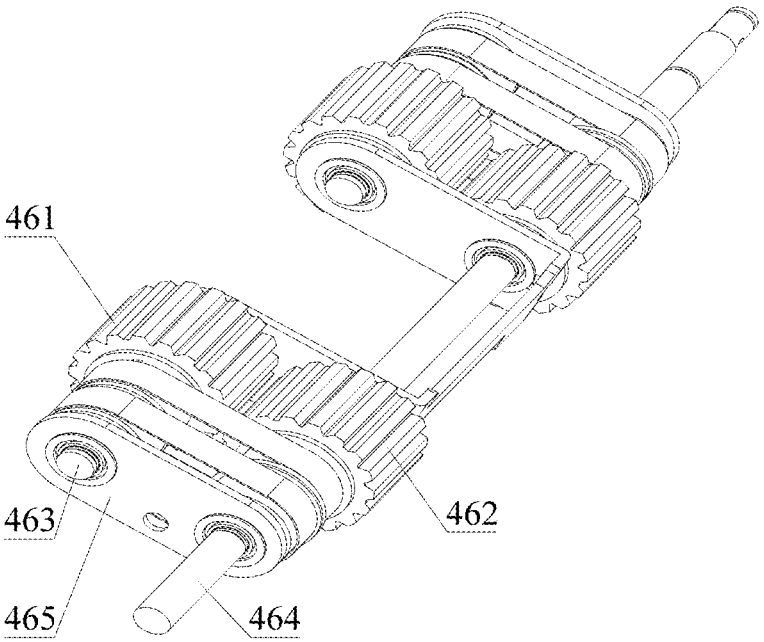
FIG. 8 is a schematic view showing the structure of a banknote dispensing roller wheel according to an embodiment of the present application.

In a further technical solution, the roller wheel driving mechanism connected to the banknote dispensing roller wheels 46 includes a rotational member 49 fixed to the rotation shaft 464 of the second roller wheel 462, an electromagnetism component 45 cooperating with the rotational member 49 to apply a rotation driving force, and a reset member 51 connected to the rotational member 49. The reset member 51 is generally embodied as a spring, and one end of the reset member 51 can be directly fixed to the box body 29. As shown in FIG. 5, when the recycling cash box mechanism is in a banknote depositing stage, the electromagnetism component 45 is deenergized, the reset member 51 applies a thrust force on the rotational member 49 to position the banknote dispensing roller wheels 46 at the lateral side of the banknote receiving vane wheel 43 to form the banknote blocking mechanism. When the recycling cash box mechanism is in a banknote dispensing stage, the electromagnetism component 45 is energized and applies a pulling force on the rotational member 49 to make the rotational member 49 rotate, and to further drive the rotation shaft 464 of the second roller wheel 462 to rotate, and finally make the first roller wheel 461 rotate to the upward side of the second roller wheel 462, thereby accomplishing the object of the whole banknote dispensing roller wheels 46 being in contact with the banknotes with a large area. In contrast, this driving mechanism has a simple structure. Certainly, the electromagnetism component 45 being energized may also position the banknote dispensing roller wheels 46 at the lateral side of the banknote receiving vane wheel 43, therefore, the specific arranging manner of the electromagnetism component 45 and the reset member 51 is not limited in the present application.

In practice, in the roller wheel driving mechanism, the rotational member 49 cooperates with the electromagnetism component 45 through a pushing lever 48 and may also be connected to the reset member 51 through a reset lever 50, that is, the electromagnetism component 45 applies an attraction force on the pushing lever 48 and the reset member 51 is directly connected to the reset lever 50. This arranging manner allows the rotational member to rotate more reliably and effectively.

For simplifying the internal structure of the box body 29, in an embodiment of the present application, the banknote receiving vane wheel 43 and the banknote dispensing roller wheels 46 are both arranged outside the box body 29; a gate 27 is rotatably provided at one end, opposite to the banknote receiving vane wheel 43 and the banknote dispensing roller wheels 46, of the box body 29, and a pushing shaft 28 is connected to the gate 27. When the gate 27 is closed, the banknotes are reliably placed inside the box body 29 due to the blocking of the gate 27. During the process of installing the recycling cash box mechanism into the vault, firstly the box body 29 is installed into the vault, and the gate 27 is opened when the pushing shaft 28 of the box body 29 comes into contact with a stopping block of the vault, and the transmission mechanism may be connected to the box body 29 at this moment. The gate 27 is opened, thus the internal space of the box body 29 is in communication with the space where the transmission mechanism is located, and the banknotes can be conveyed between the transmission mechanism and the box body 29.

Compared to the technical solution of arranging the whole transmission mechanism inside the box body 29, the above arranging manner apparently decreases the number of parts inside the box body 29, simplifies the structure of the box body, and makes it convenient to assemble and disassemble as well as to maintain later. Further, during the process of entering into the box body 29, the banknotes will not collide with the banknotes already stacked in the box body 29 and other parts in the box body 29 due to the simplified internal structure of the box body 29, therefore, the banknote deformation and jam phenomena will not occur.

In a preferred technical solution, the end of the box body 29 provided with the gate 27 is provided with a banknote blocking rod, the banknote blocking rod is located between the banknote dispensing roller wheel 46 and the banknote pressing plate 31. The arrangement of the banknote blocking rod makes the banknote subject to more restraint when being stacked inside the box body 29, to avoid the banknotes bursting out of the space between the banknote pressing plate 31 and the banknote receiving vane wheel 43 meanwhile avoid the banknotes applying a pressure on the banknote receiving vane wheel 43, to facilitate reducing the workload of the banknote receiving vane wheel 43. Furthermore, the banknote blocking rod includes a first banknote blocking rod 33 and a second banknote blocking rod 34, both of which are respectively located at two sides of the banknote pressing plate 31. Apparently, the first banknote blocking rod 33 and the second banknote blocking rod 34 acting on the banknotes at the same time can reliably restrain the banknotes, to make the banknotes be in a more stable condition.

A banknote conveyor belt 32 is arranged inside the box body 29 according to an embodiment of the present application, to make sure that the banknotes can be orderly stacked inside the box body 29. The banknote stacking plate is provided with a conveyor belt accommodating groove, and the upper surface of the banknote conveyor belt 32 is higher than the upper surface of the banknote stacking plate. When the banknotes rotate together with the banknote receiving vane wheel 43 and are blocked by the banknote dispensing roller wheel 46, the banknotes slip off onto the banknote stacking plate and come into contact with the banknote conveyor belt 32, and at this moment, the top of the banknotes has a trend of moving toward the banknote pressing plate 31 and the bottom of the banknotes also has a trend of moving toward the banknote pressing plate 31 due to the pulling force applied on the banknotes by the banknote conveyor belt 32. Therefore, under the action of the banknote conveyor belt 32, the banknotes can be stacked on the banknote pressing plate 31 in an approximately upright state.

To facilitate the power transmission of the recycling cash box mechanism, a first driving wheel 35, a first transmission wheel 36, a second transmission wheel 37, a third transmission wheel 38, a fourth transmission wheel 39 and a fifth transmission wheel 40 are arranged on the outer side of the box body 29. An external driving source drives the second driving wheel 44 which meshes with the first driving wheel 35, to drive the first driving wheel 35 to rotate, and the first driving wheel 35 drives the first transmission wheel 36, the second transmission wheel 37, the third transmission wheel 38, the fourth transmission wheel 39 and the fifth transmission wheel 40 to rotate via a belt, and finally drives the banknote conveyor belt 32 to operate. Preferably, the cross section of the banknote conveyor belt 32 is circular, which is better for driving the banknotes to move.

The pulley 42, the banknote receiving vane wheel 43 and the second driving wheel 44 in the above solutions may be driven by an electrical machine which is preferably embodied as a motor in the present application. Besides, the recycling cash box mechanism according to each embodiment of the present application can not only be arranged in a horizontal direction but also be arranged in a perpendicular direction, and the relative position of various parts may be appropriately adjusted in specific implementations, therefore, the recycling cash box mechanism arranged in any direction is deemed to fall into the scope of the present application.

A banknote processing device is also provided according to an embodiment of the present application, which includes a recycling cash box mechanism, and the recycling cash box mechanism is the recycling cash box mechanism according to any one of the above solutions. Since the recycling cash box mechanism has the above technical effects, therefore the banknote processing device having the recycling cash box mechanism also has the corresponding technical effects, which will not be illustrated herein.

A banknote processing device and a recycling cash box mechanism thereof according to the present application are described in detail hereinbefore. The principle and the embodiments of the present application are illustrated herein by specific examples. The above description of examples is only intended to help the understanding of the method and idea of the present application. It should be noted that, for the person skilled in the art, a few of modifications and improvements may be made to the present application without departing from the principle of the present application, and these modifications and improvements are also deemed to fall into the scope of the present application defined by the claims.

The invention claimed is:

1. A recycling cash box mechanism of a banknote processing device, comprising a box body and a transmission mechanism configured to be connected to the box body, wherein the transmission mechanism comprises a banknote receiving vane wheel configured to be located at a banknote dispensing/receiving port of the recycling cash box mechanism, and a banknote dispensing roller wheel configured to be located opposite to a banknote stacking plate of the box body, and the banknote dispensing roller wheel is configured to be located at a lateral portion of the banknote receiving vane wheel to form a banknote blocking mechanism.

2. The recycling cash box mechanism according to claim 1, wherein the banknote dispensing roller wheel comprises a first roller wheel and a second roller wheel rotatably cooperating with the first roller wheel, a rotational shaft of the first roller wheel and a rotational shaft of the second roller wheel are fixedly connected, and the rotational shaft of the second roller wheel is rotatable around its own axis.

3. The recycling cash box mechanism according to claim 2, wherein two or more groups of the banknote dispensing roller wheels are provided, and two sides of the banknote receiving vane wheel are each provided with at least one group of the banknote dispensing roller wheels.

4. The recycling cash box mechanism according to claim 3, wherein a connecting line between banknote contacting points of at least two groups of the banknote dispensing roller wheels respectively located at the two sides of the banknote receiving vane wheel is in parallel with an axis of the banknote receiving vane wheel.

5. The recycling cash box mechanism according to claim 4, wherein the banknote receiving vane wheel and the banknote dispensing roller wheel are both installed outside the box body, and a gate is rotatably provided at one end, opposite to the banknote receiving vane wheel and the banknote dispensing roller wheel, of the box body.

6. The recycling cash box mechanism according to claim 4, wherein a banknote conveyor belt is arranged inside the box body, the banknote stacking plate is provided with a conveyor belt accommodating groove, and an upper surface of the banknote conveyor belt is higher than an upper surface of the banknote stacking plate.

7. The recycling cash box mechanism according to claim 3, wherein the banknote receiving vane wheel and the banknote dispensing roller wheel are both installed outside the box body, and a gate is rotatably provided at one end, opposite to the banknote receiving vane wheel and the banknote dispensing roller wheel, of the box body.

8. The recycling cash box mechanism according to claim 3, wherein a banknote conveyor belt is arranged inside the box body, the banknote stacking plate is provided with a conveyor belt accommodating groove, and an upper surface of the banknote conveyor belt is higher than an upper surface of the banknote stacking plate.

9. The recycling cash box mechanism according to claim 2, wherein a roller wheel driving mechanism connected to the banknote dispensing roller wheel comprises a rotational member fixed with respect to the rotational shaft of the second roller wheel, an electromagnetism component cooperating with the rotational member to apply a rotation driving force, and a reset member connected to the rotational member.

10. The recycling cash box mechanism according to claim 9, wherein the banknote receiving vane wheel and the banknote dispensing roller wheel are both installed outside the box body, and a gate is rotatably provided at one end, opposite to the banknote receiving vane wheel and the banknote dispensing roller wheel, of the box body.

11. The recycling cash box mechanism according to claim 9, wherein a banknote conveyor belt is arranged inside the box body, the banknote stacking plate is provided with a conveyor belt accommodating groove, and an upper surface of the banknote conveyor belt is higher than an upper surface of the banknote stacking plate.

12. The recycling cash box mechanism according to claim 2, wherein the banknote receiving vane wheel and the banknote dispensing roller wheel are both installed outside the box body, and a gate is rotatably provided at one end, opposite to the banknote receiving vane wheel and the banknote dispensing roller wheel, of the box body.

13. The recycling cash box mechanism according to claim 2, wherein a banknote conveyor belt is arranged inside the box body, the banknote stacking plate is provided with a conveyor belt accommodating groove, and an upper surface of the banknote conveyor belt is higher than an upper surface of the banknote stacking plate.

14. The recycling cash box mechanism according to claim 1, wherein the banknote receiving vane wheel and the banknote dispensing roller wheel are both installed outside the box body, and a gate is rotatably provided at one end, opposite to the banknote receiving vane wheel and the banknote dispensing roller wheel, of the box body.

15. The recycling cash box mechanism according to claim 14, wherein one end of the box body provided with the gate is provided with a banknote blocking rod, the banknote blocking rod is located between the banknote dispensing roller wheel and a banknote pressing plate inside the box body.

16. The recycling cash box mechanism according to claim 15, wherein the banknote blocking rod comprises a first banknote blocking rod and a second banknote blocking rod, both of which are respectively located at two sides of the banknote pressing plate.

17. The recycling cash box mechanism according to claim 1, wherein a banknote conveyor belt is arranged inside the box body, the banknote stacking plate is provided with a conveyor belt accommodating groove, and an upper surface of the banknote conveyor belt is higher than an upper surface of the banknote stacking plate.

18. A banknote processing device, comprising a recycling cash box mechanism, wherein the recycling cash box mechanism comprises a box body and a transmission mechanism configured to be connected to the box body, and the transmission mechanism comprises a banknote receiving vane wheel configured to be located at a banknote dispensing/receiving port of the recycling cash box mechanism, and a banknote dispensing roller wheel configured to be located opposite to a banknote stacking plate of the box body, and the banknote dispensing roller wheel is configured to be located at a lateral portion of the banknote receiving vane wheel to form a banknote blocking mechanism.

19. The banknote processing device according to claim 18, wherein the banknote dispensing roller wheel comprises a first roller wheel and a second roller wheel rotatably cooperating with the first roller wheel, a rotational shaft of the first roller wheel and a rotational shaft of the second roller wheel are fixedly connected, and the rotational shaft of the second roller wheel is rotatable around its own axis.

20. The banknote processing device according to claim 19, wherein a roller wheel driving mechanism connected to the banknote dispensing roller wheel comprises a rotational member fixed with respect to the rotational shaft of the second roller wheel, an electromagnetism component cooperating with the rotational member to apply a rotation driving force, and a reset member connected to the rotational member.

* * * * *